United States Patent [19]

Bean

[11] 4,453,870

[45] Jun. 12, 1984

[54] ACCUMULATOR

[75] Inventor: Harley F. Bean, Grapevine, Tex.

[73] Assignee: The Mead Corporation, Dayton, Ohio

[21] Appl. No.: 355,827

[22] Filed: Mar. 8, 1982

[51] Int. Cl.[3] ..... B65H 31/30

[52] U.S. Cl. ..... 414/43; 198/624; 227/103; 271/220; 271/246

[58] Field of Search ..... 414/43, 109; 271/207, 271/220, 246, 273, 274; 227/2, 3, 5, 100, 103, 150; 198/624

[56] References Cited

U.S. PATENT DOCUMENTS

| | | | |
|---|---|---|---|
| 2,821,123 | 1/1958 | Fuller . | |
| 3,556,513 | 1/1971 | Howard | 271/207 X |
| 3,630,607 | 12/1971 | Korn et al. | 355/6 |
| 3,690,650 | 9/1972 | Maier, Jr. et al. . | |
| 3,704,793 | 12/1972 | Nicol et al. | 271/207 |
| 3,719,266 | 3/1973 | Korn et al. . | |
| 3,785,256 | 1/1974 | Nikkel . | |
| 3,883,063 | 5/1975 | Fassman et al. | 227/100 X |
| 3,966,194 | 1/1976 | Abbé et al. | 271/186 |
| 3,972,525 | 8/1976 | Foster et al. | 271/221 |
| 3,994,427 | 11/1976 | Ganatsiou | 227/3 X |
| 4,073,391 | 2/1978 | O'Brien et al. | 271/246 X |

*Primary Examiner*—Leslie J. Paperner

*Attorney, Agent, or Firm*—Biebel, French & Nauman

[57] ABSTRACT

An accumulator is used with a duplicating device such as a duplicating machine having an upper level conveyor for transporting single sheets of paper and a lower level working area for processing the sheets and includes a frame positioned at an angle to the horizontal which receives single sheets from the upper level conveyor, a gate bracket communicating with the frame, a gate extending across the gate bracket and rotatably mounted thereto, upper and lower front pinch rollers positioned in front of the gate, and upper and lower rearward rollers. The upper front and rearward rollers are connected by a linkage so that they are maintained at the same distance above their respective lower rollers when the front pinch rollers engage a set of sheets. Single sheets accumulate in a set against the gate and are held together by the upper and lower front pinch rollers. The gate opens and the front pinch rollers propel the set of sheets between the rearward rollers to the working area.

26 Claims, 9 Drawing Figures

ACCUMULATOR

BACKGROUND OF THE INVENTION

1. Field of the Invention

The present invention relates to devices for collecting sheets of material into a set, and more particularly, to devices for collecting sheets of paper in sets and conveying them to a subsequent station.

2. Prior Art

Duplicating machines are becoming increasingly sophisticated and many types are capable of performing additional operations on sheets of paper once they have been duplicated by the duplicator. For example, duplicators may include a device which receives a set of sheets and binds it together to form a pamphlet. Since the sheets bound to form the pamphlet are duplicated serially, it is necessary to collect the sheets from the duplicating portion of the machine into a set, then transport the set in a manner that minimizes skewing of the sheets to a station where they can be bound or otherwise processsed.

There are many devices now used for collecting the output of the duplicating portion of a duplicating machine. One example is disclosed in U.S. Pat. No. 3,972,525 which is directed to a sheet stacking assembly which includes a reciprocating jogging finger extending above a substantially horizontal plate across which the duplicated sheets travel. The sheets are propelled across the plate by the momentum they receive from sliding down an inclined plane and by a roller protruding from the plate ahead of the jogging finger. The sheets pass over the reciprocating jogging finger which then urges them toward a stop. After the sheets have been collected against the stop, they can be processed further and bound by means such as a stapling device.

After the sheets have been stacked against the stop and bound, the stop is lowered into the surface of the table and a pair of pinch rollers engage the bound set to drive it onto a subsequent station. A disadvantage of this system is that the action of the reciprocating jogging finger as well as a roller which protrudes above the floor of the supporting surface may cause the sheets to float and become arranged in a skewed position with respect to each other.

Another example is disclosed in U.S. Pat. No. 3,719,266, which is directed to a stacking device which utilizes a gravity feed. Sheets are fed serially through pinch rollers and downwardly between baffles to a gate. The sheets rest vertically against the gate as they are being collected into a set. A disadvantage of this device is that it requires additional powered components such as paddle wheels to arrange the sheets into a set.

Accordingly, there is a need for an accumulator which can collect sheets into a set in a manner that minimizes the possibility of the sheets becoming skewed with respect to one another. In addition, there is a need for an accumulator which can transport a set of collected sheets to a finishing station with a minimum amount of skewing of the individual sheets. Furthermore, such an accumulator should have a simplified construction and should be adjustable to collect and transport sets of sheets having varying thicknesses.

SUMMARY OF THE INVENTION

The present invention provides an accumulator in which sheets are fed by gravity against a gate to be collected in a set, thereby eliminating the need for rollers and other powered devices for transporting sheets to the gate. Once the sheets have been collected into a set, a single pair of powered pinch rollers transports the set through the open gate. A set of upper rearward rollers is downstream from the pair of powered rollers and is linked to them so that it is automatically maintained at a height above a set of fixed, driven, lower rearward rollers so that the set of collected sheets may pass between the upper and lower rearward rollers and the floor to prevent floating and disorientation of the sheets. The upper rearward rollers are positioned without additional motors or pneumatic cylinders.

The accumulator of the present invention is preferably used with a duplicating machine having an upper level conveyor for transporting single sheets of paper or the like, and a lower level finishing station for processing sheets which have been collected into sets of varying height. The accumulator comprises a trough-shaped frame which is positioned at an angle to the horizontal, between 15°–75° and preferably 60°, a trough-shaped gate bracket having an arcuate base contiguous with the floor of the frame, a gate rotatably mounted to and extending across the gate bracket, upper and lower front pinch rollers rotatbly mounted to the gate bracket, upper and lower rearward rollers, and a linkage mounting the upper rearward rollers and connecting the upper front rollers to them. The gate is operated by a spring-return pneumatic cylinder which is capable of adjusting the gate to an open position such that a collected set of sheets may pass under the gate, or to a closed position in which the gate is substantially normal to and contacts the base of the gate bracket so that sheets may be collected against the gate into a set.

The upper front pinch rollers extend between a pair of spring-load arms rotatably mounted to the gate bracket and supported by a pair of spring-carrier arms which are also rotatably mounted to the gate bracket and whose axes of rotation are concentric with that of the spring-load arms. The spring-carrier arms engage the spring-load arms so that the spring-carrier arms may be rotated to lift the spring-load arms away from the floor of the gate bracket to raise the upper front rollers. The spring-load arms are spring loaded with respect to the spring-carrier arms to accommodate sets of varying thicknesses. The lower front pinch rollers rotatably held by a U-shaped lower drive bracket rotatably mounted to the gate bracket below the floor. The floor of the frame has a plurality of slots formed adjacent the gate so that the lower front rollers may be positioned to protrude slightly above the floor of the gate bracket to engage a set of sheets. Thus, the separation of the upper and lower front rollers away from the floor of the gate bracket allows sheets to collect unhindered against a closed gate. Pinching the front rollers together clamps them against a collected set. The front rollers preferably are both motor driven so that a pinched set may be transported through the gate bracket to a lower level finishing station.

The upper rearward rollers, which are mounted on a linkage attached to the gate bracket and joined to the upper front rollers, rotate toward or away from the lower rearward rollers as the upper front rollers move with respect to the lower front rollers. Thus, the upper and lower rearward rollers are positioned apart the same distance as the upper and lower front rollers when the front rollers are engaging a set of sheets.

The top of the frame preferably is covered by a plurality of wire guides which are arcuate in shape and extend lengthwise along the frame to the gate. The guides form a concave surface such that paper ejected into the frame which is airborne slidably engages the concave profile of the guides. The guides thus direct the sheets along an arcuate path which noses the leading edges of the sheets downward against the gate and causes the trailing edge to "whip" against the base of the frame rapidly to eliminate interference with a next succeeding sheet entering the frame.

The components of the accumulator are selectively activated by a computer control such that, during a sheet collecting mode, the gate is in a closed position and the front rollers are rotated away from the floor of the gate bracket to permit the collecting of sheets into a set without interference. Once the sheets have been collected into a set, the control causes the front rollers to pinch the set. The gate is then rotated to an open position and the front rollers propel the set beneath the gate. The upper rearward rollers, having been positioned by the linkage the proper height above the lower rearward rollers, may now receive the leading edge of the set and engage the uppermost surface of this set to prevent floating or skewing of the sheets during the transportation from the gate to s lower level finishing station of the duplicating machine.

Accordingly, it is an object of the present invention to provide an accumulator which receives sheets serially and collects them into sets by gravity without use of rollers or other driving means; an accumulator in which a pair of front rollers and a pair of rearward rollers are maintained at the same spacing without independent positioning devices; and an accumulator in which the operation of the various components is effected with a minimum of mechanical driving apparatus.

Other objects of the invention will be apparent from the following description, the accompanying drawings, and the appended claims.

DETAILED OF THE PREFERRED EMBODIMENTS

Figure 1:
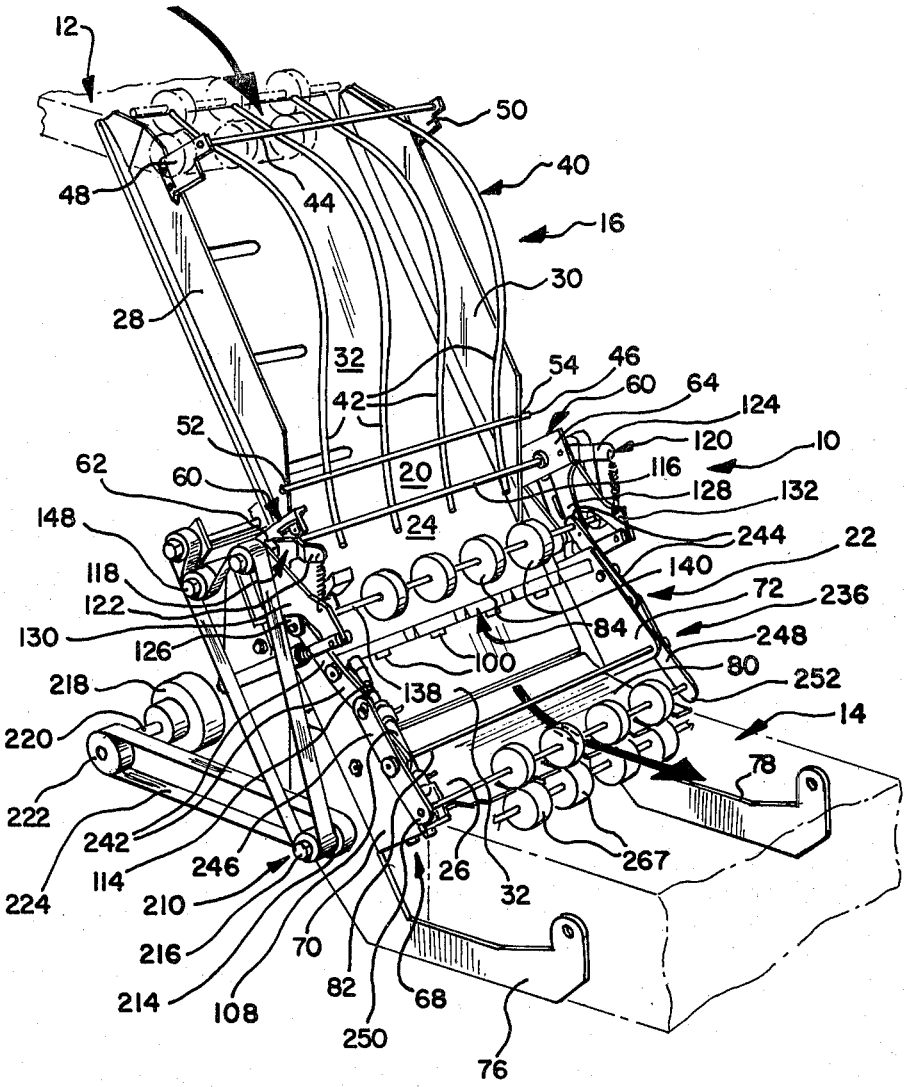
FIG. 1 is a perspective view of a preferred embodiment of the accumulator of the present invention.

As shown in FIG. 1, the accumulator, generally designated 10, is designed to be used in combination with an upper level conveyor 12 and a lower level finishing station 14. The upper level conveyor 12 and finishing station 14 may be part of a duplicating machine (not shown) such that duplicated sheets are transported by upper level conveyor 12 to the accumulator 10 which, in turn, conveys them to finishing station 14 where they may be further processed, such as being bound or stapled into sets.

Figure 2:
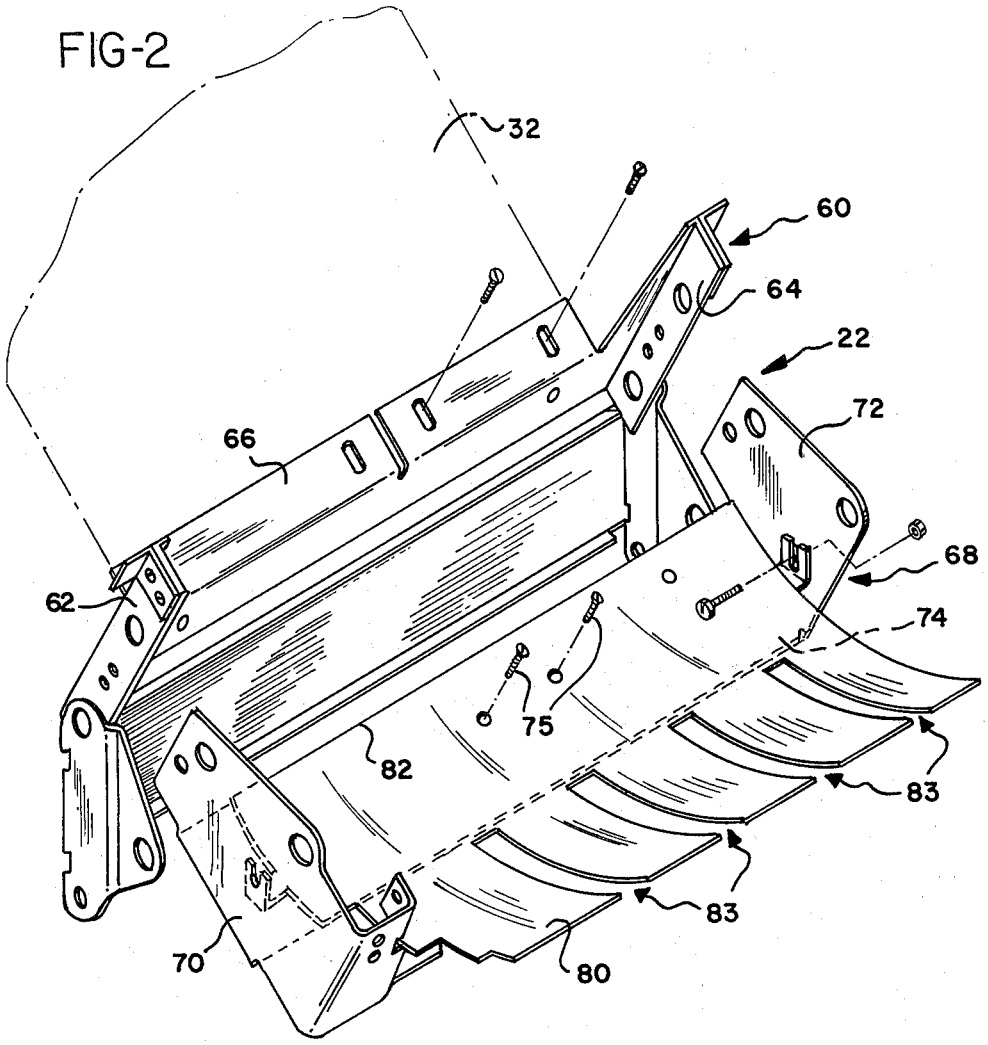
FIG. 2 is a perspective view of the gate bracket, outlet plate, roller drive bracket, and frame floor, which is shown in phantom.
Figure 3:
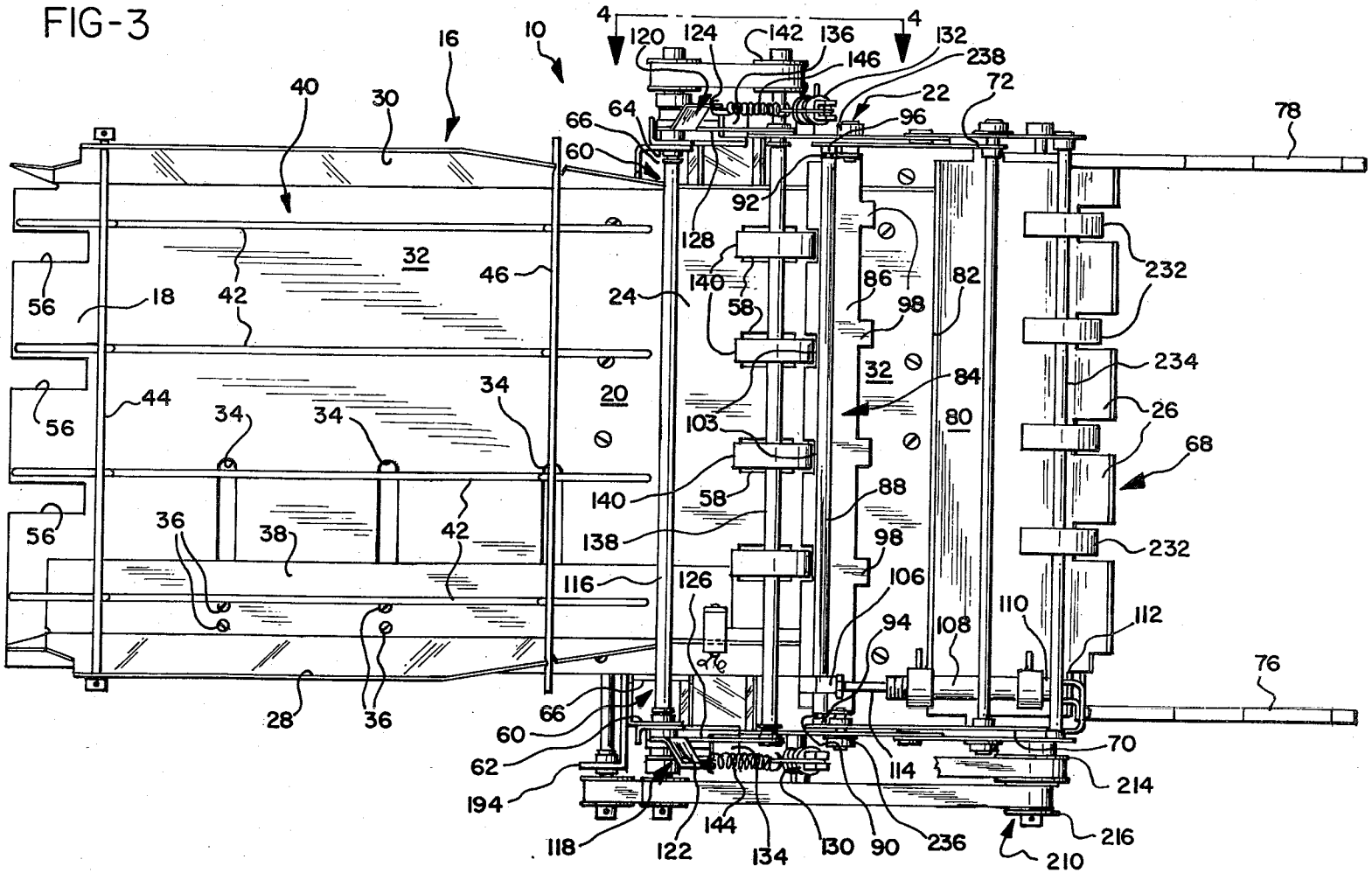
FIG. 3 is a plan view of the accumulator of FIG. 1 taken at line 3—3 of FIG. 7.

As shown in FIGS. 1, 2, and 3, the accumulator includes a frame 16 having an intake end 18 and a discharge end 20, and a gate bracket 22 having an inlet 24, communicating with the discharge end 20, and an outlet 26 which may communicate with the finishing station 14.

Figure 7:
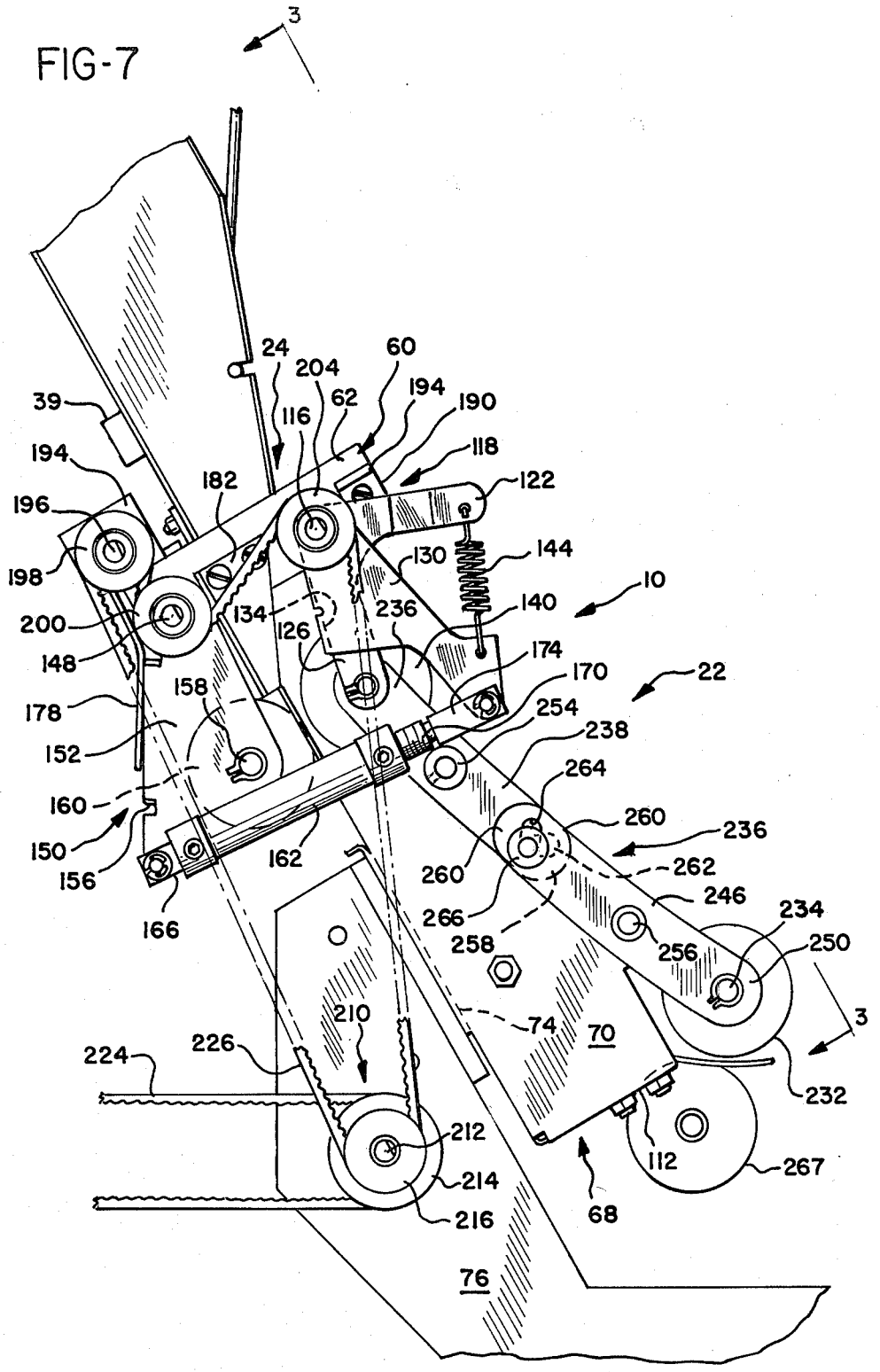
FIG. 7 is a partial side elevation of the accumulator of FIG. 1 showing the upper and lower front pinch rollers rotated downwardly toward the floor of the gate bracket.

The frame 16 is generally trough-shaped and includes a pair of opposing, downwardly converging walls 28, 30 which extend upwardly from a floor 32 which extends through gate bracket 22 to terminate near the outlet 26. As shown in FIG. 3, the floor 32 defines slots 34 which receive screws 36 carried by a flange 38 forming a portion of the wall 28. Screws 36 thread into rail slides 39 beneath the floor 32 (FIG. 7). Thus, wall 28 can be adjusted relative to wall 30 so that the frame 16 can be adjusted in width to accommodate sheets of varying thicknesses.

As shown in FIGS. 1 and 3, the frame 16 is enclosed by guide means 40 which extends from the intake end 18 to the discharge end 20 of the frame. The guide means 40 preferably consists of a plurality of tubular wire guides 42, each having an arcuate profile such that its concavity opens downwardly toward and faces the floor 32 of the frame. The guides 42 are held in position by an upper crossbar 44 and lower crossbar 46. Upper crossbar 44 is journalled into guide brackets 48, 50 which are riveted to the opposing walls 28, 30 respectively. Lower crossbar 46 is held in position within notches 52, 54 formed in the walls 28, 30 at a location proximate the discharge end 20 of the frame. Thus, the guide means 40 can be rotated about the upper crossbar 44 simply by grasping the lower crossbar 46 and pulling it out of notches 52, 54. The guides 42 will deform slightly to permit attachment and removal of the lower crossbar 46 from the notches 52, 54.

The floor 32 of the frame 16 may also include upper roller cutouts 56 formed proximate the intake end 18 to accommodate pinch rollers of an upper level conveyor 12. Similarly, the floor 32 of the frame 16 may define lower roller cutouts 58 which are located proximate the discharge end 20 to permit lower pinch rollers associated with the gate bracket 22 to protrude above the floor to engage sheets.

The frame 16 is oriented so that the floor 32 makes an angle of between 15° and 75° with the horizontal. Angles outside of this range would not permit sheets to encounter and travel along the guide means 40 to be "whipped" by the arcuate path described by the guide means so that their trailing edges lay against the floor 32 and avoid interfering with the next following sheet. At a preferred angle of 60°, this whipping action is not effective.

As shown in FIG. 2, the gate bracket 22 includes a squeeze roller bracket 60 which has opposing side walls 62, 64 located on either side of the gate bracket inlet 24. Opposing side walls 62, 64 of the squeeze roller bracket 60 are joined by a cross member 66 which extends beneath and attaches to the floor 32 of the frame 16. The gate bracket 22 also includes a roller support member 68 having opposing side walls 70, 72, joined by a cross panel 74 which extends across the gate bracket 22 and is mounted to the floor 32 by screws 75. As shown in FIGS. 1, 3, and 7, a pair of legs 76, 78 are attached to the underside of the cross panel 74. Legs 76, 78 are generally L-shaped and extend outward away from the outlet 26 of the gate bracket 22 and provide means for engaging finishing station 14.

Referring to FIG. 2, an outlet plate 80 is attached to the side walls 70, 72 of roller support member 68 and overlaps floor 32. Outlet plate 80 preferably is arcuate in shape and has a beveled edge 82 which provides a smooth transition from the floor 32 thereby eliminating the possibility that a sheet of paper may become damaged or stopped in its travel by contact with a projecting edge. The plate 80 includes a terminal portion which defines slots 83 for receiving rollers, as hereinafter set forth.

Figures 5, 9:
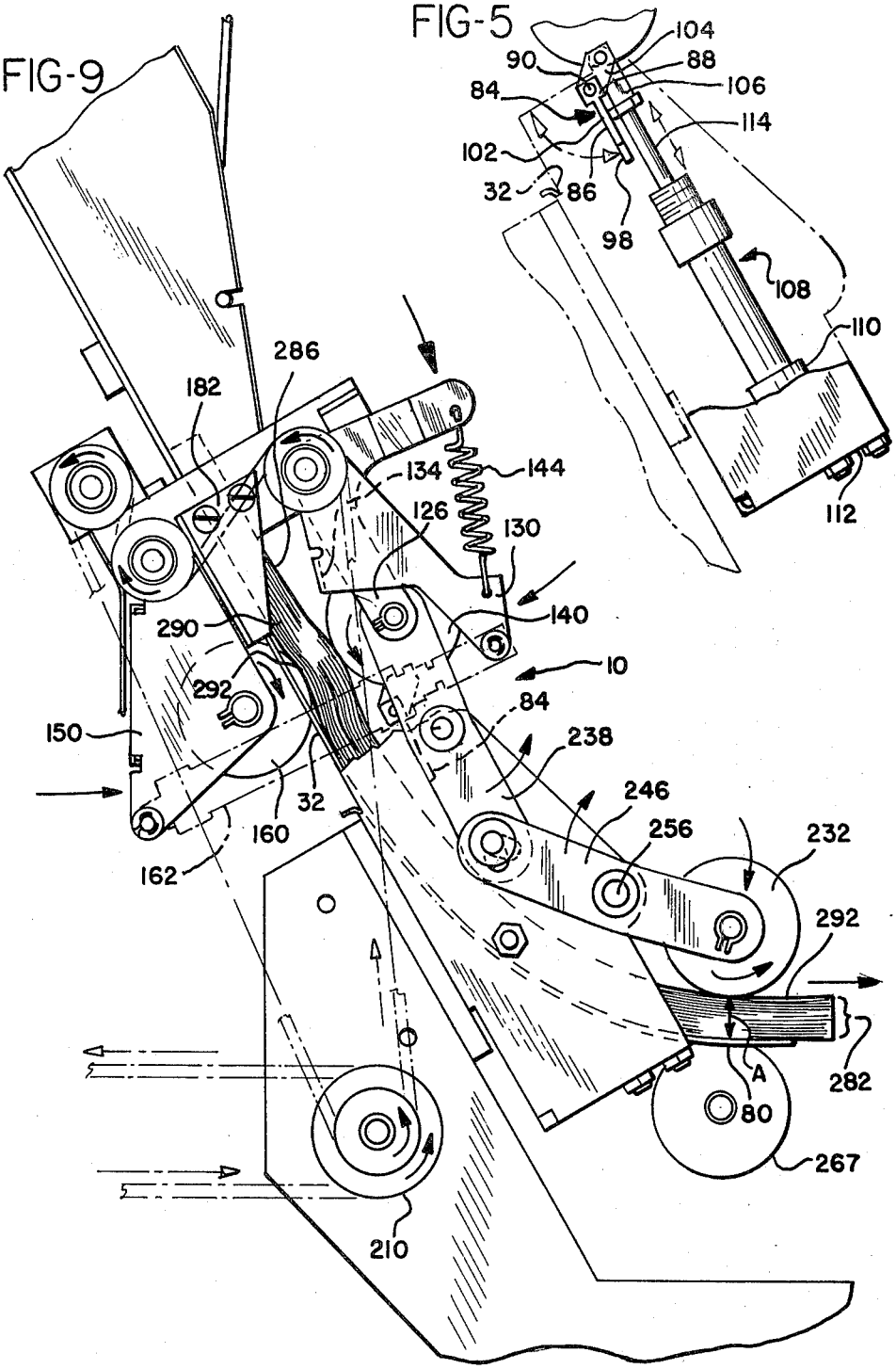
FIG. 5 is a partial side elevation of the gate and spring-return pneumatic cylinder of the accumulator of FIG. 1, with the gate bracket shown broken away.
FIG. 9 is a side elevation of the accumulator in which the upper and lower front rollers have been rotated to pinch a set of sheets and drive them out of the accumulator.

As shown in FIGS. 1, 3, and 5, a gate 84 is rotatably mounted between the gate bracket 22 and extends between the side walls 70, 72 of the roller support member 68. The gate 84 includes a plate portion 86 and an axle portion 88. The axle portion 88 receives studs 90, 92 which are journalled into bosses 94, 96 mounted on side walls 70, 72 respectively.

The plate portion 86 extends downwardly from the axle portion 88 and terminates in fingers 98. Floor 32 of the frame 16 includes openings 100 spaced to receive the fingers 98 when the plate portion 86 is rotated downwardly toward the floor. This insures that there are no gaps between the bottom of the plate portion 86 and the floor 32 through which a sheet may pass during the stacking operation. The plate portion 86 also includes a planar surface 102 (see FIG. 8) which faces the inlet 24 of the gate bracket 22. When the gate 84 is rotated so that the plate portion is substantially normal to the floor 32 of the frame 16, the planar surface 102 provides a surface against which the leading edges of sheets may abut during a stacking operation.

The gate 84 includes upper cutouts 103 spaced along its upper edge. Upper cutouts 103 provide clearance between the gate 84 and rollers when the gate is rotated to be parallel to the floor.

The axle portion 88 of the gate 84 includes a bracket 104 which receives a clevis 106 of a spring-return pneumatic cylinder 108 (FIG. 5). The cylinder 108 is rotatably mounted at its base 110 to a rear wall 112 of the roller support member 68. The rod 114 of the cylinder 108 is mounted to the clevis 106. Thus, displacement of the rod 114 causes the gate 84 to rotate about studs 90, 92 and raises and lowers the plate portion 86.

The gate 84 is shown in FIGS. 3 and 5 in an open position; that is, the planar surface 102 has been rotated about studs 90, 92 so that it is substantially parallel to the floor 32 of the frame 16. Conversely, the gate 84 is shown in FIG. 7 in a closed position such that its planar surface 102 has been rotated to be substantially normal to the floor 32 of the frame 16. In this closed position, fingers 98 are positioned within openings 100 (FIGS. 1 and 3).

Figure 4:
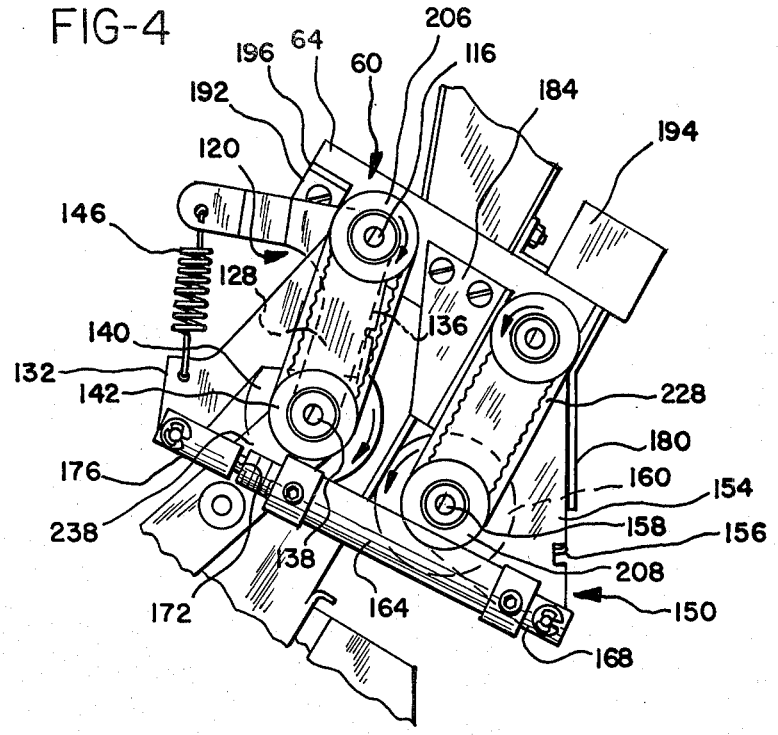
FIG. 4 is a partial side elevation of the drive pulleys of the upper and lower front rollers, taken at line 4—4 of FIG. 3.

As shown in FIGS. 1, 3, 4, and 7, the squeeze roller bracket 60 rotatably supports an axle 116 on which is mounted a pair of spring-load arms 118, 120. Spring-load arms 118, 120 each are generally L-shaped and include first legs 122, 124 and second legs 126, 128. Axle 116 also rotatably receives spring-carrier arms 130, 132. Spring-carrier arms 130, 132 each have inwardly projecting flanges 134, 136. The inwardly projecting flanges 134, 136 engage and support the second legs 126, 128 of the spring-load arms 118, 120, respectively. Thus, as spring-carrier arm 130 is rotated counterclockwise, as shown in FIG. 7, flange 134 engages the second leg 126 of the spring-load arm 118, causing the spring-load arm to likewise rotate in a counterclockwise direction. Similarly, when spring-carrier arm 132 is rotated in a clockwise direction, as shown in FIG. 4, flange 136 engages second leg 128 and causes the spring-load arm 120 to rotate in a clockwise direction.

Second legs 126, 128 support an axle 138 to which are fixedly mounted upper front rollers 140. As shown in FIGS. 3 and 4, axle 138 extends through second leg 128 of spring-load arm 120 and terminates in a pulley 142. Pulley 142 is fixedly mounted to axle 138 such that rotation of the pulley causes the upper front rollers 140 to rotate with the axle. First legs 122, 124 are joined to spring-carrier arms 130, 132, respectively, by coil extension springs 144, 146.

Squeeze roller bracket 60 also supports axle 148 which extends across the gate bracket 22 beneath the floor 32 of the frame 16. A lower drive bracket 150 is rotatably mounted to the axle 148 and thus may rotate relative to the squeeze roller bracket 60. The lower drive bracket 150 is generally U-shaped and includes a pair of opposing triangular walls 152, 154 joined by a cross plate 156 which extends beneath the floor 32 of the frame 16. Triangular walls 152, 154 rotatably support a lower drive axle 158 to which is fixedly mounted a plurality of lower drive rollers 160. The size and spacing of the lower drive rollers 160 on the lower drive axle 158 corresponds to the size and spacing of the upper front rollers 140. The lower drive rollers 160 are also positioned to extend upwardly through lower roller cutouts 58 formed in the floor 32. Thus, the upper front rollers 140 and lower drive rollers 160 together form a set of upper and lower front pinch rollers.

The spring-carrier arms 130, 132 are joined to the lower drive bracket 150 by spring-return pneumatic cylinders 162, 164. Cylinders 162, 164 are rotatably mounted at their bases 166, 168 to the triangular walls 152, 154. Cylinder rods 170, 172 are threaded into clevises 174, 176 which are rotatably mounted to the spring-carrier arms 130, 132. Thus, extension of the cylinders 162, 164 causes the spring-carrier arms 130, 132 to rotate away from the triangular walls 152, 154 of the lower drive bracket, causing the upper front rollers 140 to be rotated away from the lower drive rollers 160.

The squeeze roller bracket 160 includes lower drive bracket stops 178, 180, which are mounted beneath the squeeze roller bracket below the opposing side walls 62, 64, respectively. The lower drive bracket stops 178, 180 extend outwardly from the opposing side walls 62, 64 to provide a surface against which the lower drive bracket triangular walls 152, 154 may rest, thereby defining a lowermost position of the lower drive bracket 150.

Lower drive bracket upper stops 182, 184 are screwed onto the opposing side walls 62, 64 and include outwardly extending flanges 186, 188 which present a surface defining the upward extent of travel of the roller drive bracket 150, since rotation of the lower drive bracket upwardly toward the floor 32 causes the upper surface of the triangular walls 152, 154 to engage the flanges 186, 188, respectively.

Similarly, the squeeze roller bracket 60 includes spring-load arm stops 190, 192 which are screwed onto the opposing side walls 62, 64. Spring-load arm stops 190, 192 are generally L-shaped and include outwardly extending flanges which are positioned to engage the first legs 122, 124 of the spring-load arms 118, 120, thereby defining an upper limit of travel of the spring-load arms.

As shown in FIGS. 1, 3, and 7, the squeeze roller bracket 60 supports an idler pulley bracket 194 which is mounted beneath the floor 32 at a point below the discharge end 20 of the frame 16. The idler pulley bracket 194 is generally U-shaped and rotatably receives an idler pulley shaft 196. Idler pulley shaft 196 extends outwardly from the idler pulley bracket 194 and supports an idler pulley 198. As shown in FIGS. 4 and 7, axle 148 supports lower drive pulleys 200, 202, which are fixedly mounted at the ends of the axle. Similarly, axle 116 supports upper drive pulleys 204, 206.

As shown in FIG. 4, axle 158 supports roller pulley 208 and, as mentioned previously, axle 138 supports pulley 142. As shown in FIGS. 3 and 7, a double pulley 210 is fixedly mounted to a drive axle 212 which is rotatably mounted to legs 76, 78. Double pulley 210 consists of an inner pulley 214 and an outer pulley 216.

As shown in FIGS. 1 and 7, a motor 218, which may be mounted beneath the accumulator 10, includes a drive shaft 220 to which is fixedly mounted a drive pulley 222. Drive pulley 222 is linked by a belt 224 to inner pulley 214. Outer pulley 216 is linked by belt 226 to idler pulley 198, lower drive pulley 200, and upper drive pulley 204. Thus, rotation of drive pulley 222 by the motor 218 causes the double pulley 210 to rotate, thereby causing rotation of pulleys 198, 200, and 204.

As shown in FIG. 4, lower drive pulley 202 is linked with lower pulley 208 by belt 228, and upper drive pulley 206 is linked with pulley 142 by a belt 230. Thus, rotation of lower drive pulleys 200, 202 by the outer pulley 216 of double pulley 210 causes roller pulley 208 and pulley 142 to rotate in opposite directions, thereby causing upper front rollers 140 and lower drive rollers 160 to rotate in opposite directions. As shown in FIG. 7, a counterclockwise rotation of double pulley 210 causes a counterclockwise rotation of upper front rollers 140 and a clockwise rotation of lower drive rollers 160. Although the preferred embodiment of the accumulator 10 is described so that both upper front rollers 140 and lower drive rollers 160 are driven, it is possible to utilize only a single set of driven rollers adjacent the gate 84 and not depart from the scope of the invention.

As shown in FIGS. 1, 3, and 7, upper front rollers 140 are joined to a set of upper rearward rollers 232, which are mounted on a rearward axle 234, by a linkage 236. Linkage 236 consists of a pair of first follower arms 238, 240, which are rotatably mounted to axle 138 at their front ends 242, 244, and a pair of second follower arms 246, 248, which are rotatably mounted to axle 234 at their rearward ends 250, 252. First and second follower arms 238, 246 are identical in construction and arrangement to first and second follower arms 240, 248. Hence, the following discussion of the structure and arrangement of the follower arms shall be limited to the first and second follower arms 238, 246, as shown in FIGS. 1 and 7, with the understanding that the discussion applies equally to the first and second follower arms 240, 248.

First follower arm 238 is generally elongate in shape and is rotatably mounted to side wall 70 of roller support member 68 by a rivet 254 located midway along the length of the arm. Similarly, second follower arm 246 is generally elongate in shape and is rotatably mounted to side wall 70 midway along its length by axle 256, which extends across the gate bracket 22 and is journalled into side wall 72, as well. First follower arm 238 includes a linking end 258 which is intersected by a linking end 260 of second follower arm 246.

As shown in FIG. 7, linking end 258 of first follower arm 238 defines an oblong opening 262 whose major axis is disposed at an angle to the lengthwise dimension of the first follower arm. Similarly, linking end 260 of second follower arm 246 defines an opening 264. Opening 264 is oblong in shape and its major axis is disposed at an angle to the lengthwise dimension of the linking end of the second follower arm. A floating rivet 266 is inserted through the openings 262, 264 and thus joins the first and second follower arms 238, 246 together so that they may rotate with respect to one another. It should be noted that the shape and angular disposition of the openings 262, 264 permits rotation of the first and second follower arms 238, 246 about their respective rotational axes, namely rivet 254 and axle 256, within a limited range.

Figure 8:
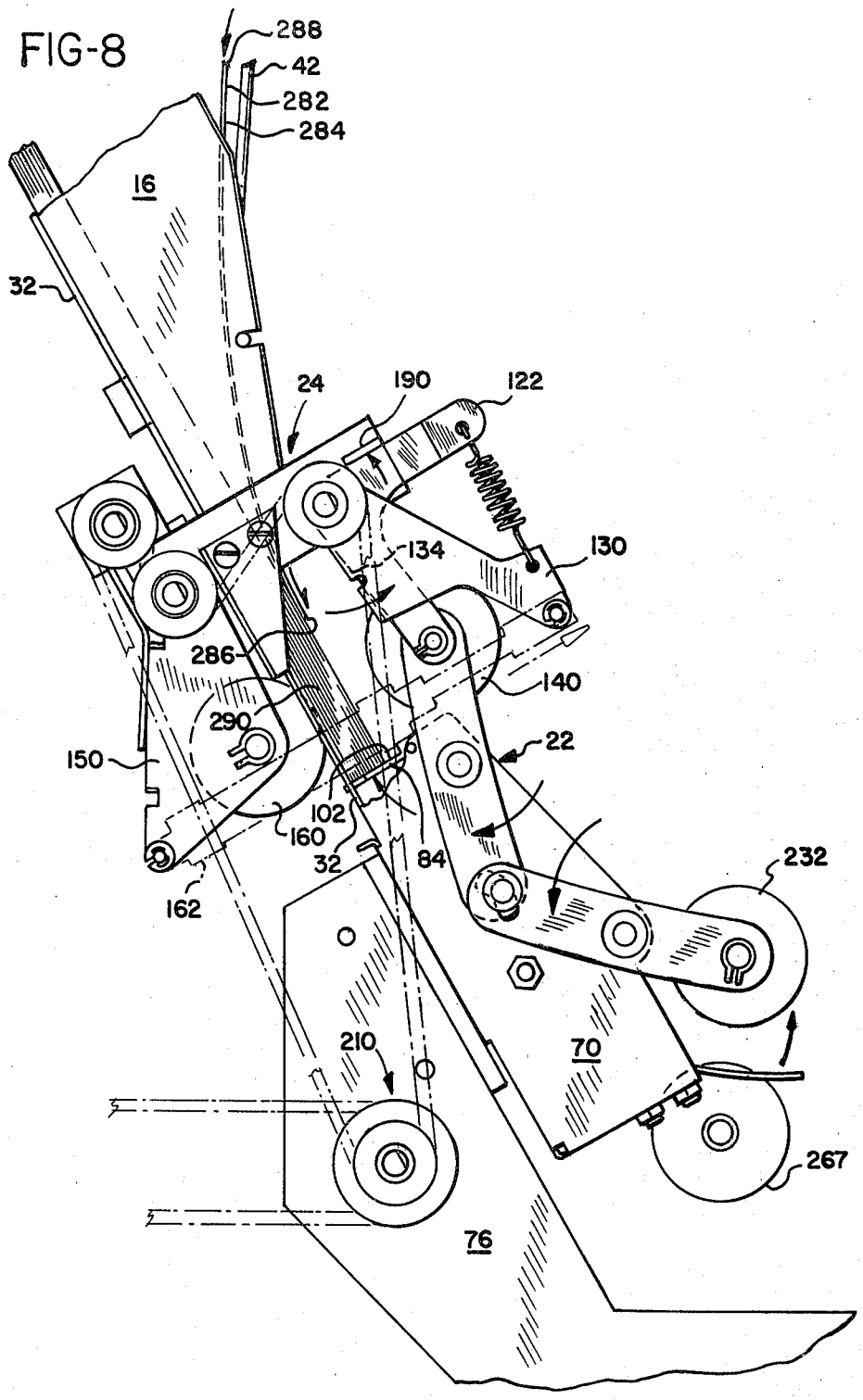
FIG. 8 is a side elevation of the accumulator of FIG. 7 showing sheets being collected in a set against the gate, and in which the gate bracket is partially broken away and the cylinder which positions the upper and lower front rollers is shown in phantom.

As shown in FIGS. 1, 8, and 9, a set of fixed, continuously driven, lower rearward rollers 267 are positioned below the upper rearward rollers 232 and in slots 83 of outlet plate 80. Rollers 267 may be carried by finishing station 14, as shown in FIG. 1. Rollers 267 are positioned to project upwardly through slots 83.

Figure 6:
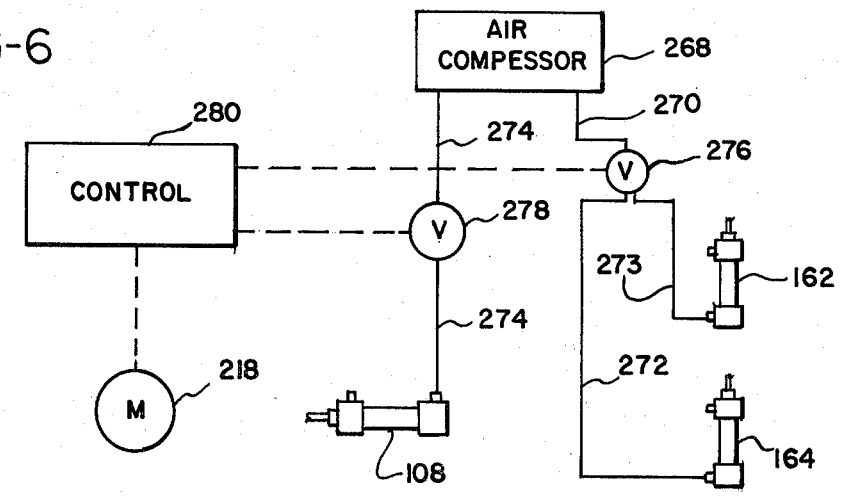
FIG. 6 is a schematic diagram of the control system for operating the accumulator of FIG. 1.

As shown in FIG. 6, the cylinders 162, 164, which rotate the upper front rollers and lower drive rollers toward and away from the floor of the frame, and the cylinder 108 which positions the gate in the opened and closed positions are powered by a source of compressed air such as an air compressor 268. Compressor 268 communicates with cylinders 162, 164 by feed lines 270, 272, 273, and with cylinder 108 by feed line 274. Positioned on feed line 270 is a servo-valve 276, and positioned on feed line 274 is a second servo-valve 278. Servo-valves 276, 278 are actuated by a computer control 280 which also actuates motor 218. Thus, computer control 280 can selectively position servo-valve 276 to actuate cylinders 162, 164 thereby causing the upper front rollers and lower drive rollers to move toward or away from the floor, and can position valve 278 to actuate cylinder 108, thereby rotating the gate to an open position.

The operation of the accumulator 10 is shown in FIGS. 7, 8, and 9 and is as follows. In FIGS. 3 and 6, the accumulator 10 is shown prior to the introduction of sheets of paper into the inlet 24 of the gate bracket 22. Cylinders 162, 164 are retracted so that the lower drive bracket 150 rests against the lower drive bracket stops 178, 180 and the spring-carrier arms 130, 132 are rotated downwardly toward the floor 32 so that upper front rollers 140 are proximate the floor. Thereafter, the gate is rotated to its closed position, as shown in FIG. 8.

As shown in FIG. 8, the control 280 has activated the cylinders 162, 164 to extend so that the spring-carrier arms 130, 132 are rotated in a counterclockwise direction such that flanges 134, 136 engage the spring-load arms 118, 120 and cause them to also rotate in a counterclockwise direction, thereby lifting the upper front rollers 140 away from the floor 32 of the frame 16.

Cylinders 162, 164 extend until the first legs 122, 124 engage the spring-load arm stops 190, 192. This causes the cylinder to urge the lower drive bracket 150 downwardly so that the lower drive rollers 160 are maintained at a position beneath the floor 32 so they do not interfere with the movement of sheets across the floor. The upper front rollers 140 are likewise rotated away from the movement of sheets to eliminate possible interference.

As sheets 282 are fed into the frame 16 from an upper level conveyor 12 (shown in FIG. 1), they travel along the frame such that their uppermost surfaces 284 slide along the underside of the guides 42. The guides 42 direct the leading edge 286 of the sheets 282 downwardly at the inlet 24 of the gate bracket 22, and the natural "whip" of the paper as it is directed downwardly causes the trailing edge 288 of each sheet to lie flat against the floor 32 to eliminate interference with a next succeeding sheet. Repeated feeding of sheets 282 into the frame 16 in this fashion creates a set 290 of sheets whose leading edges 286 abut the planar surface 102 of the gate 84.

As shown in FIG. 9, once the set 290 has been formed completely, the accumulator 10 transports the set to a finishing station 14 (shown in FIG. 1) where it may be bound or undergo other processing. The computer control (shown in FIG. 6) activates the cylinders 162, 164 to retract, thereby drawing the upper front rollers 140 and the lower drive rollers 160 toward the floor 32 to pinch the set 290. As the cylinders 162, 164 retract, they cause the spring-carrier arms 130, 132 to rotate in a clockwise direction, and the lower drive bracket 150 to rotate in a counterclockwise direction. Once the upper front rollers 140 have engaged the uppermost surface 286 of the uppermost sheet, the second legs 126, 128 separate from and are no longer supported by the flanges 134, 136 so that the rollers 140 are held against the set by the action of the coil extension springs 144, 146. The lower drive bracket 150 is rotated in a counterclockwise direction so that the lower drive rollers 160 extend upwardly through the lower roller cutouts 58 to engage the lowermost surface 292 of the set 290. Further rotation of the lower drive bracket 150 is impeded by the lower drive bracket upper stops 182, 184.

The positioning of the upper front rollers 140 causes the first follower arms 238, 240 to rotate in a counterclockwise direction, as the rollers engage the paper, which causes second follower arms 246, 248 to rotate in a clockwise direction, thus causing the upper rearward rollers 232 to rotate in a clockwise direction about axle 256 toward the lower rearward rollers 267. The size and position of the first and second follower arms 238, 240, 246, 248 is such that the position of the upper rearward rollers 232 above the lower rearward rollers 267 is at a distance, designated by the letter A in FIG. 9, which is substantially the same as the distance between the upper front rollers 140 and the lower drive rollers 160, which is the thickness of the set 290. In addition, the lower drive rollers 160 extend through the floor 32 to a distance equal to the amount that lower rearward rollers 267 extend through plate 80. The upward position of rollers 160 is determined by the position of lower drive block upper stops 182, 184, which limit the travel of lower drive bracket 150.

Once the computer control has retracted the cylinders 162, 164 so that the upper front rollers 140 and lower drive rollers 160 engage and pinch the set 290, the computer control activates cylinder 108 (shown in FIG. 6) to move the gate 84 to an open position. At the same time, the computer control activates the motor 218 (shown in FIG. 6) to drive the double pulley 210 which rotates the upper front rollers 140 and the lower drive rollers 160 to propel the set 290 along the floor 32 and outlet plate 80 of the gate bracket 22. As the set encounters the upper and lower rearward rollers 232, 267 the individual sheets 282 are maintained in registry by the compressive force exerted by the upper and lower rearward rollers, now at the proper spacing. The set 290 can then be conveyed to a lower finishing station 14 (shown in FIG. 1) by lower rearward rollers 267 in a manner that reduces the likelihood of the individual sheets 282 becoming skewed.

The accumulator preferably is comprised of components which can be fabricated from cold rolled steel. The wire guides of the frame preferably are fabricated from stainless steel to prevent the accumulation of oxide or rust which may inhibit the travel of paper across the guides during the collecting process. The rollers preferably are made of hardened rubber or any other material that has the appropriate frictional qualities which would reduce slippage when in contact with paper. The belts preferably are timing belts which would minimize slip so that the rollers can be started and stopped at precise time intervals.

While the form of apparatus herein described constitutes a preferred embodiment of this invention, it is to be understood that this invention is not limited to this precise form of apparatus and that changes may be made therein without departing from the scope of the invention.

What is claimed is:

1. An accumulator for sheets of paper or the like comprising:

intake means including a floor which extends angularly downward and having an intake and an outlet at upper and lower ends thereof, respectively;

gate means at said outlet actionable to a closed position for stopping sheets which are propelled into said inlet, thereby accumulating sheets into a set, and to an open position to allow an accumulated set therepast;

a pair of pinch rollers proximate said outlet and said gate means for grasping an accumulated set of sheets;

a pair of rearward rollers for grasping a set of sheets conveyed from said pinch rollers therebetween;

means for linking said pinch rollers to said rearward rollers such that a distance between said rearward rollers corresponds to a distance between said pair of pinch rollers when an accumulated set is grasped by said pinch rollers;

roller positioning means for holding said pinch rollers open and away from said floor when said gate means is in said closed position and for urging said pinch rollers into a set engaging position when said gate means is in said open position; and motive means for driving at least one of said pair of pinch rollers to transport an accumulated set of sheets through said outlet to said rearward rollers.

2. The accumulator of claim 1 and further comprising guide means for urging said sheets in a downward direction from said inlet toward said gate.

3. The accumulator of claim 1 wherein said roller positioning means comprises means for adjustably controlling the operating gap between said pinch rollers to accommodate sets of sheets having arbitrarily different thicknesses.

4. An accumulator for sheets of paper or the like comprising:

intake means including a floor which extends angularly downward, an inlet at an upper end of said floor, and an outlet at a lower end of said floor;

a gate at said outlet for stopping sheets which are propelled into said inlet and causing sheets to accumulate into a set on said floor;

gate operating means for closing said gate to stop sheets, and opening said gate when a set of sheets has been accumulated on said floor;

a pair of pinch rollers proximate said outlet and said gate for grasping a set of sheets;

a pair of rearward roller means for grasping a set of sheets during movement along a path beyond said gate;

means for linking said pinch roller pair to said pair of rearward roller means such that a distance between said pair of rearward roller means corresponds to a distance between said pair of pinch rollers when a set is grasped by said pinch rollers;

roller positioning means for holding said pinch rollers open and away from said floor when said gate is closed and for urging said pinch rollers into a set engaging position when said gate is opened, said roller positioning means including means for adjustably controlling an operating gap between said pinch rollers to accommodate sets of sheets having arbitrarily different thicknesses;

motive means for driving at least one of said pair of pinch rollers to transport a set of sheets through said outlet; and guide means for urging sheets in a downward direction from said inlet toward said gate.

5. The accumulator of claim 4 wherein said roller positioning means are spring operated.

6. The accumulator of claim 5 and further comprising a pair of side walls extending upwardly from said floor.

7. The accumulator of claim 4 wherein the downward slope of said floor is greater than 30° from the horizontal.

8. The accumulator of claim 7 wherein the downward slope of said floor is about 60°.

9. For use with an upper level conveyor for transporting single sheets of paper or the like, and a lower level finishing station for processing sheets of paper arranged in sets of varying height, an accumulator comprising:

a frame having a floor positioned at an angle to the horizontal and having an intake end for receiving single sheets of paper from an upper level conveyor, and a discharge end for collecting sheets in a stacked relationship;

a gate bracket having an inlet contiguous with said discharge end of said frame and receiving said floor, and an outlet for communicating with a lower level working area, said gate bracket having a base from said inlet to said outlet;

a gate extending across said inlet and rotatably mounted to said gate bracket, said gate having a substantially planar surface and positioned in said inlet such that said surface may support and retain a set of sheets located in said discharge end of said frame and said inlet of said gate bracket;

means for rotating said gate to an open position wherein said surface is substantially parallel to a proximate portion of said base such that a collected set in said discharge end and said inlet may pass thereacross to said gate bracket outlet, and to a closed position wherein said surface is substantially normal to and contacts said proximate portion of said base, such that sheets may be collected and held against said surface;

upper and lower front roller means positioned between said gate and said discharge end, each of said upper and lower front roller means rotatably mounted to said gate bracket and adjustable relative to said floor;

positioning means for alternately holding said upper and lower front roller means in a spaced relation and away from said floor, then urging said front roller means toward said floor to engage a set of sheets supported by said gate;

upper and lower rearward rollers, said upper rearward rollers rotatably mounted to said gate bracket proximate said outlet and adjustable relative to said base and said lower rearward rollers positioned below said upper rearward rollers;

means for linking said front roller means to said rearward roller means such that said rearward roller means is responsive to displacement of said front roller means with respect to said floor by said positioning means and said upper and lower rearward rollers are maintained in a spaced relation which is substantially equal to the distance between said upper and lower front rollers so that a set of sheets collected at said gate may pass between said upper and lower rearward rollers to said outlet;

means for selectively rotating said at least one of said upper and lower front rollers and at least one of said upper and lower rearward rollers;

control for selectively activating said gate rotating means, said positioning means, said front roller rotating means, and said rear roller rotating means such that said gate rotating means is activated to place said gate in a closed position and said positioning means holds said front roller means above said base so that sheets may be collected in a set against said gate, said positioning means may be activated to urge said upper and lower front roller means against a set retained by said gate, and said gate rotating means, said front roller rotating means, and said rearward roller rotating means may be activated so that a collected set may be propelled by said front rollers and said rearward rollers along said floor and said base and out said outlet to a lower level working area.

10. The accumulator of claim 9 wherein said positioning means comprises:

at least one spring-load arm rotatably mounted to said gate bracket;

at least one spring-carrier arm having means for engaging and supporting said spring-load arm, said spring-carrier arm being rotatably mounted to said gate bracket;

a first axle rotatably mounted to said spring-load arm and extending across said gate bracket inlet; and said upper front rollers being fixedly mounted to said first axle.

11. The accumulator of claim 10 wherein said spring-load arm includes first leg means and second leg means for supporting said axle, said first and second leg means joined to each other at an end and disposed at an angle to each other.

12. The accumulator of claim 11 wherein said positioning means further comprises:

at least one lower drive bracket rotatably mounted to said gate bracket;

a lower drive axle extending across said base and capable of rotation by said selective rotating means;

said lower front rollers being fixedly mounted on said lower drive axle; and a drive bracket stop mounted to said gate bracket for supporting said gate bracket at a predetermined lower position wherein said lower front rollers are below said base.

13. The accumulator of claim 12 wherein said positioning means further comprises a first spring-return cylinder rotatably mounted to said spring-carrier arm at an upper end and to said lower drive bracket at a lower end, and spring means extending between said first leg means and said spring-carrier arm such that extension of said cylinder rotates said spring-carrier arm and said lower drive bracket away from said base, causes said supporting means to engage said second leg means of said spring-load arm thereby rotating said spring-load arm so that said front rollers move upward from said base and urges said lower drive bracket against said drive bracket stop, and contraction of said cylinder causes said spring-carrier arm to rotate toward said base, said spring means urges said spring-load arm to rotate so that said rollers move downwardly to said base to engage a set of sheets thereunder, and said lower drive bracket is rotated to bring said lower front rollers above said base to engage a set of sheets thereabove.

14. The accumulator of claim 13 further comprising a rear axle extending across said base ahd mounted to said linking means, said axle mounting said upper rearward rollers thereon.

15. The accumulator of claim 14 wherein said linking means comprises:

a first follower arm having a central portion rotatably mounted to said gate bracket, a front end rotatably mounted to said spring-load arm, and a rearward end; and a second follower arm having a central portion rotatably mounted to said gate bracket, a front end rotatably mounted to said rearward end of said first follower arm so as to permit rotation of said first and second follower arms about said respective central positions, and a rear end supporting said upper rearward roller axle such that rotation of said spring-load arm causes said upper rearward roller to be rotated on said second follower arm thereby maintaining said upper front rollers and said upper rearward rollers at the same distance above their respective lower front and lower rearward rollers, when said front rollers are grasping a set of sheets.

16. The accumulator of claim 15 wherein said front end of said first follower arm is rotatably mounted to said first axle.

17. The accumulator of claim 16 wherein said lower rearward rollers comprise driven rollers fixedly positioned with respect to said floor and below said upper rearward rollers.

18. The accumulator of claims 9 or 17 wherein said frame includes a substantially planar floor at least a portion of which communicates with said base and forms a continuous surface therewith.

19. The accumulator of claim 18 wherein said frame further comprises guide means positioned over said floor for guiding single sheets injected between said floor and said guide means at said intake end to said discharge end to be collected in said stacked relation.

20. The accumulator of claim 19 wherein said guide means has a generally concave shape which opens downwardly toward and faces said floor to guide sheets from said intake end to said discharge end of said frame in an arcuate path.

21. The accumulator of claim 20 wherein said guide means comprises a plurality of rod means extending from said intake end to said discharge end.

22. The accumulator of claim 21 wherein said frame includes opposing downwardly converging side walls extending from said intake end to said discharge end and positioned on opposite sides of said floor.

23. The accumulator of claim 22 wherein at least one of said sides is adjustable relative to said floor such that the distance between said sides may be varied to accommodate sheets of varying widths.

24. The accumulator of claims 23 wherein said gate bracket includes a pair of opposing side walls and said gate is rotatably mounted to said side walls at a location above said floor such that said gate may be rotated to said open position to permit a set of sheets to pass thereunder along said base.

25. The accumultor of claim 24 wherein said gate includes a pivot rotatably mounted to said side walls, a plate extending outwardly therefrom and having said planar surface, and a lobe extending outwardly from said pivot.

26. The accumulator of claim 25 wherein said gate rotating means includes a second spring-return cylinder mounted at an end to said gate bracket and at an opposite end to said lobe.

* * * * *